US008373100B2

(12) United States Patent
Kahr

(10) Patent No.: US 8,373,100 B2
(45) Date of Patent: Feb. 12, 2013

(54) HEATING ELEMENT

(75) Inventor: Werner Kahr, Deutschlandsberg (AT)

(73) Assignee: Epcos AG, Munich (DE)

( * ) Notice: Subject to any disclaimer, the term of this patent is extended or adjusted under 35 U.S.C. 154(b) by 31 days.

(21) Appl. No.: 12/393,793

(22) Filed: Feb. 26, 2009

(65) Prior Publication Data

US 2009/0212041 A1 Aug. 27, 2009

Related U.S. Application Data

(63) Continuation of application No. PCT/DE2007/001556, filed on Aug. 31, 2007.

(30) Foreign Application Priority Data

Sep. 1, 2006 (DE) ..... 10 2006 041 054

(51) Int. Cl.
*H05B 3/12* (2006.01)
*H05B 3/03* (2006.01)

(52) U.S. Cl. ..... 219/553; 219/541; 29/611

(58) Field of Classification Search ..... 219/553, 219/505, 611, 619, 201, 552; 338/22 R, 338/212, 204; 392/453, 488
See application file for complete search history.

(56) References Cited

U.S. PATENT DOCUMENTS

| | | | | |
|---|---|---|---|---|
| 3,027,529 | A | 3/1962 | Schoefer et al. | |
| 3,437,789 | A * | 4/1969 | Charbonnier et al. | 219/209 |
| 3,748,439 | A | 7/1973 | Ting et al. | |
| 3,927,300 | A | 12/1975 | Wada et al. | |
| 4,899,032 | A | 2/1990 | Schwarzl et al. | |
| 5,663,702 | A * | 9/1997 | Shaw et al. | 337/183 |
| 6,339,020 | B1 * | 1/2002 | Weihs et al. | 438/643 |
| 6,346,496 | B2 * | 2/2002 | Nabika et al. | 501/137 |
| 6,791,179 | B2 * | 9/2004 | Kawamoto | 257/700 |
| 6,820,795 | B2 * | 11/2004 | Fujii | 228/121 |
| 6,852,955 | B1 * | 2/2005 | Golan et al. | 219/505 |
| 7,800,028 | B2 * | 9/2010 | Wang | 219/540 |
| 7,820,950 | B2 * | 10/2010 | Keite-Telgenbuscher et al. | 219/553 |
| 2002/0027492 | A1 * | 3/2002 | Nagao et al. | 338/22 R |
| 2003/0052004 | A1 * | 3/2003 | Isitani et al. | 204/424 |
| 2003/0056584 | A1 * | 3/2003 | Park | 73/204.11 |

FOREIGN PATENT DOCUMENTS

| | | | |
|---|---|---|---|
| DE | 1 415 406 | | 8/1970 |
| DE | 39 00 787 | A1 | 7/1990 |
| EP | 1 480 233 | A1 | 11/2004 |
| JP | 6-21191 | U | 3/1994 |
| JP | 8-148262 | A | 6/1996 |
| JP | 10-101413 | A | 4/1998 |
| JP | 11-297504 | A | 10/1999 |
| JP | 11-345704 | A | 12/1999 |
| JP | 2003-257703 | A | 9/2003 |

OTHER PUBLICATIONS

Chongwei, C., et al., "Preparation and Performance of Aluminum Electrode of PTC Ceramic Chip," Electronic Industrial Techniques, Issue No. 1, Dec. 31, 1991, 8 pages.

* cited by examiner

*Primary Examiner* — Joseph M Pelham
(74) *Attorney, Agent, or Firm* — Slater & Matsil, L.L.P.

(57) ABSTRACT

A heating element with a ceramic body that has PTC properties is specified. The heating element has electrodes that are arranged on ceramic body. Both the ceramic body and the electrodes are lead-free.

9 Claims, 1 Drawing Sheet

HEATING ELEMENT

This application is a continuation of co-pending International Application No. PCT/DE2007/001556, filed Aug. 31, 2007, which designated the United States and was not published in English, and which claims priority to German Application No. 10 2006 041 054.8 filed Sep. 1, 2006, both of which applications are incorporated herein by reference.

BACKGROUND

Heating elements with ceramic PTC resistors are known, for example, from U.S. Pat. No. 4,899,032.

SUMMARY

In one aspect, the invention specifies an environmentally friendly heating element.

A heating element with a ceramic body that has PTC properties is disclosed. (PTC stands for "positive temperature coefficient"). The heating element has electrodes that are arranged on the ceramic body. Both the ceramic body and the electrodes are lead-free.

With the preferred heating element it is possible to essentially avoid environmental stressors connected with disposal of heavy metals.

BRIEF DESCRIPTION OF THE DRAWINGS

The heating element is explained by means of schematic, not-to-scale figures. In the figures.

The following list of reference symbols can be used in conjunction with the drawings:

1 Body

2, 3 Electrodes

2*a*, 3*a* Inner contact layer

2*b*, 3*b* Diffusion barrier layer

2*c*, 3*c* Outer contact layer

DETAILED DESCRIPTION

Figure 1:
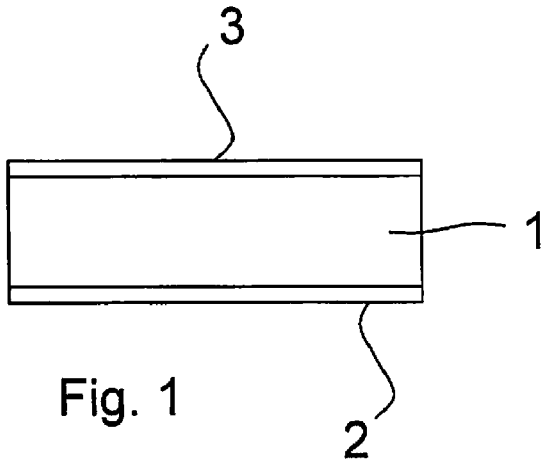
FIG. 1 shows a heating element in cross section.

The heating element shown in FIG. 1 includes a ceramic body 1, a first electrode 2, and a second electrode 3. The electrode 2 is arranged on the lower primary surface and electrode 3 on the upper primary surface of body 1. Both body 1 and electrodes 2 and 3 are lead-free.

Figure 2:
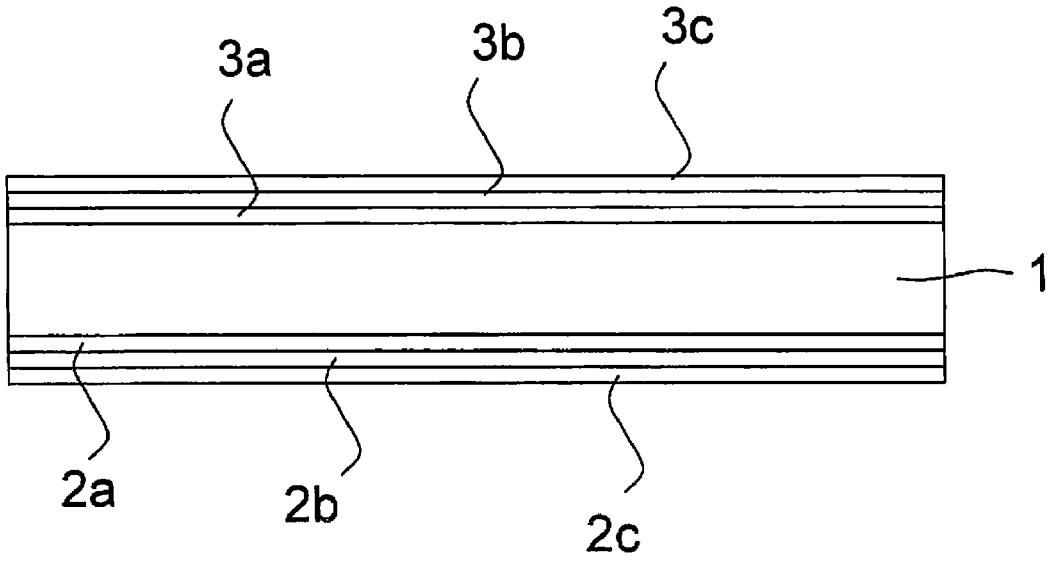
FIG. 2 shows a heating element with multilayer electrodes, in cross section.

FIG. 2 shows a variation of the heating element shown in FIG. 1, in which each electrode includes a number of layers. The lower electrode has an inner contact layer 2*a*, a diffusion barrier layer 2*b*, and another contact layer 2*c*. The upper electrode correspondingly has an inner contact layer 3*a*, a diffusion barrier layer 3*b* and another contact layer 3*c*.

The diffusion barrier layers 2*b* and 3*b* are arranged between the contact layers 2*a*, 3*a* and 2*c*, and 3*c*. The inner contact layers 2*a* and 3*a* are arranged between the body 1 and the diffusion barrier layers 2*b* and 3*b*.

Each of the layers 2*a*, 2*b*, 2*c*, 3*a*, 3*b*, 3*c* is lead-free.

The heating element can be used in motor vehicle applications in 12/24/42 V operation, preferably for heating of vehicle interiors, especially in the case of diesel vehicles (automobiles, trucks, commercial vehicles) as well as gasoline-powered vehicles. Preferably, several identical heating elements are arranged on a common carrier, electrically connected together and thus assembled into a heating system.

The ceramic body 1 is sintered. Ceramic raw materials without lead additives are used to make the ceramic body 1. The ceramic raw material preferably contains $BaTiO_3$. In one variation, the ceramic raw material contains an amount of $SrTiO_3$ (for example, in addition to the barium titanate). Alternatively, the body 1 can be free of $SrTiO_3$.

The following ceramic compositions, for example, are considered to be advantageous: $BaTiO_3$ 50-85%, $CaTiO_3$ 3-15%, $SrTiO_3$ up to 50%, $SiO_2$ 1-2%.

The electrodes 2, 3 or their partial layers 2*a*-2*c*, 3*a*-3*c* are preferably produced in a metal deposition process. Examples are sputtering, evaporation, electrolytic deposition, and chemical deposition. However, the electrodes 2, 3 can also be produced by baking on a metal paste. The thickness of the electrodes 2, 3 can be between 2 μm and 25 μm, depending on the specific embodiment.

In an advantageous embodiment, the electrodes 2, 3 can contain metallic Al as a base material. The base material of the electrodes 2, 3 can be enriched with glass flux. The amount of glass flux is preferably about 5%. The thickness of an electrode 2, 3 that contains Al as a base material and a glass flux as an additive is preferably 20 μm.

Alternatively, the glass flux can be omitted, so that the electrodes 2, 3 are free of glass additives. The thickness of an Al electrode without glass flux is preferably 4 μm.

The electrodes 2 (3) can have a layer sequence that includes several partial layers 2*a*-2*c* (3*a*-3*c*). The layer sequence can, in particular, have a base layer 2*a* (3*a*) which functions as the inner contact layer, and a diffusion barrier layer 2*b* (3*b*). The inner contact layer 2*a* (3*a*) serves for ohmic contact with the ceramic body 1. Aluminum, chromium or a zinc-containing layer, for example, is suitable as the contact layer 2*a* (3*a*). A nickel layer can be applied directly to the ceramic body 1 or to the contact layer 2*a* (3*a*) which depending on the embodiment, is suitable as a diffusion barrier layer. The layer sequence preferably also includes a conductive layer (outer contact layer 2*c* (3*c*)), which has good electric conductivity that is higher than that of the underlying layers. For example, a silver layer or a silver-containing layer is suitable as the conductive layer 2*c* (3*c*). Other layer sequences, not specified here, are also possibilities for the electrodes of the heating element.

The electrodes 2, 3 produced in a bake-on process are produced with bake-on pastes that contain an amount of glass. In producing such electrodes, a metal paste with a glass additive that is lead-free is used. The metal paste also contains organic binders, which are preferably burned off completely when baking on the electrodes.

The heating element preferably has two main surfaces. In a preferred variation, the first electrode 2 is arranged on the first primary surface and the second electrode 3 is arranged on the second primary surface.

The heating element can be designed as a surface-mountable structural element. The specific resistance of the heating element can be set, for example, between about 10 and about 500 ohm·cm. However, the resistance value is not limited to this range.

What is claimed is:

1. A heating element comprising:

a ceramic body that has positive temperature coefficient properties, wherein the ceramic body contains $CaTiO_3$ in an amount of 3-15%, $BaTiO_3$ in an amount of 50-85%, $SrTiO_3$ in an amount of up to 50% and $SiO_2$ in an amount of 1-2%; and electrodes arranged on the ceramic body, wherein the ceramic body and the electrodes are lead-free, wherein the electrodes each have a layered sequence that comprises an inner contact layer, a diffusion barrier layer and an outer contact layer.

2. The heating element of claim 1, wherein the electrodes contain Al.

3. The heating element of claim 1, wherein the electrodes contain an amount of glass.

4. The heating element of claim 1, wherein the heating elements are free of glass additives.

5. The heating element of claim 1, wherein a first electrode is arranged on a first primary surface of the ceramic body and a second electrode is arranged on a second primary surface of the electrodes.

6. The heating element of claim 1, wherein the heating element is surface mountable.

7. A heating element comprising:

a ceramic body having positive temperature coefficient properties, the ceramic body including a first primary surface and an opposed second primary surface, the ceramic body being lead free and comprising a material selected from the group consisting of $BaTiO_3$ and $SrTiO_3$;

a first electrode disposed on the first primary surface, the first electrode being lead free; and a second electrode disposed on the second primary surface, the second electrode being lead free, wherein the first and second electrodes each comprise Al, and wherein the first and second electrodes are deposited directly on the first and second primary surfaces, respectively;

wherein the first and second electrodes each have a layer sequence that comprises an inner contact layer touching the ceramic body, a diffusion barrier layer over the inner contact layer and an outer contact layer over the diffusion barrier layer.

8. The heating element of claim 7, wherein the first and second electrodes each contain an amount of glass.

9. The heating element of claim 7, wherein the first and second electrodes are each free of any glass additives.

* * * * *